US006499766B1

(12) United States Patent
Schroeder

(10) Patent No.: US 6,499,766 B1
(45) Date of Patent: Dec. 31, 2002

(54) MEDIA FOLDER IMPROVEMENTS

(76) Inventor: Karl S. Schroeder, 6822 Salem Ave., Clayton, OH (US) 45315

( * ) Notice: Subject to any disclaimer, the term of this patent is extended or adjusted under 35 U.S.C. 154(b) by 0 days.

(21) Appl. No.: 09/566,994

(22) Filed: May 9, 2000

(51) Int. Cl.[7] ..... B42D 1/00

(52) U.S. Cl. ..... 281/21.1; 281/46; 281/47; 281/48; 281/49; 402/6; 402/7; 402/8; 402/9; 402/10; 402/19; 248/309.2; 248/441; 248/442.2; 248/444; 248/445; 248/446; 248/447

(58) Field of Search ..... 281/46, 47, 48, 281/49, 21.1; 402/6, 7–10, 19; 248/309.2, 441.1, 442.2, 444, 445, 446, 447

(56) References Cited

U.S. PATENT DOCUMENTS

| | | | | | |
|---|---|---|---|---|---|
| 1,452,452 | A | * | 4/1923 | West | 281/48 |
| 1,654,191 | A | * | 12/1927 | Redies et al. | 281/34 |
| 1,736,908 | A | * | 11/1929 | Franey | 281/47 |
| 2,079,388 | A | * | 5/1937 | Vetor | 281/47 |
| 3,176,952 | A | * | 4/1965 | Gilmore | 248/317 |
| 4,840,407 | A | * | 6/1989 | Schroeder | 281/48 |
| 5,195,782 | A | * | 3/1993 | Schroeder | 248/441.1 |
| 6,108,952 | A | * | 8/2000 | Whttlef | 281/48 |
| 6,254,135 | B1 | * | 7/2001 | Girard | 281/21.1 |

* cited by examiner

*Primary Examiner*—A. L. Wellington
*Assistant Examiner*—Mark T. Henderson
(74) *Attorney, Agent, or Firm*—William Weigl

(57) ABSTRACT

A media folder or book binder provided with a rotor having elastic bands stretched between pins on its opposite ends has mounting brackets which are mechanically fastened to the spine of the folder. The brackets have trunnions facing inwardly toward the opposite ends of the rotor to journal the rotor. An important aspect of the invention is that each bracket is provided with a shroud which inhibits or prevents bands from disengaging with their supporting pins as a folded sheet is removed from or installed on the rotor under a strand of the band. In effect, winding-up of the bands during relative lateral movement of a sheet still occurs, but the adverse twisting affect of enabling the bands to slip off pins is prevented. The folder has straps fixed thereto and preferably formed integrally therewith at opposite ends of the folder's spine. These straps interact with latches on the mounting brackets to firmly hold the brackets in place mechanically.

8 Claims, 1 Drawing Sheet

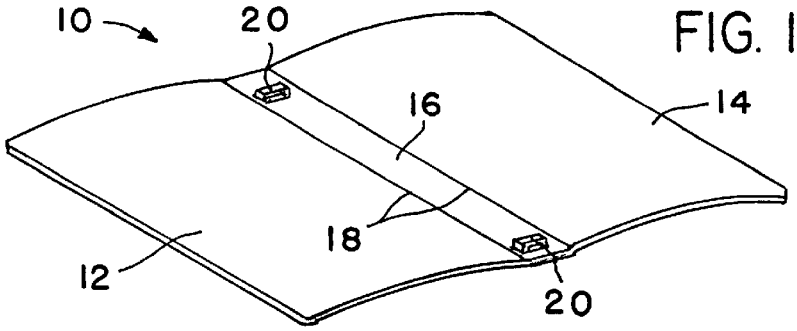
FIG. 1
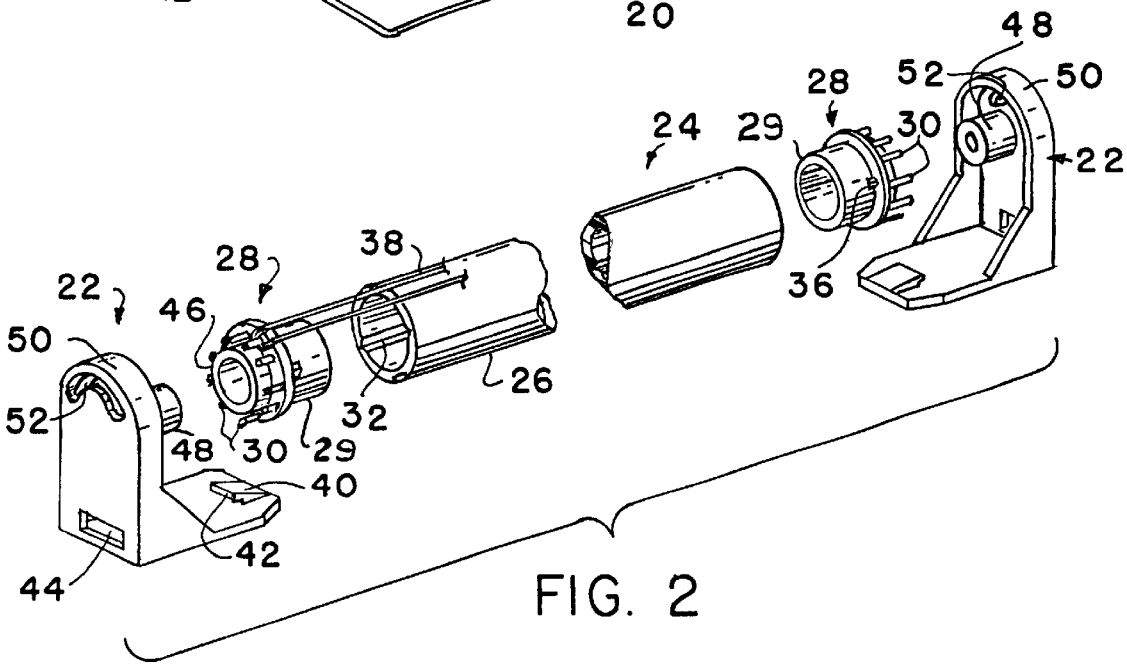
FIG. 2
FIG. 5
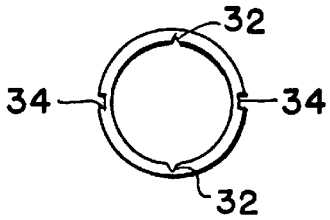
FIG. 3
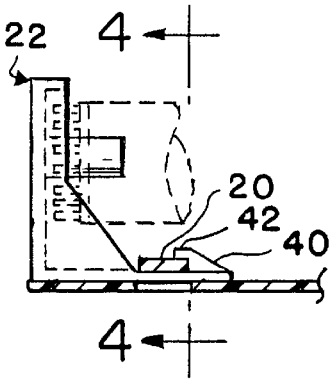
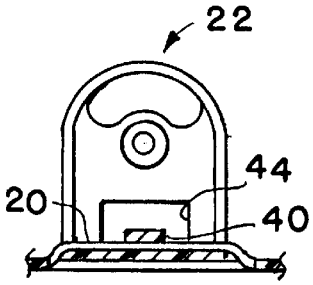
FIG. 4

MEDIA FOLDER IMPROVEMENTS

This invention relates to a media folder for carrying folded sheet material such as choral composition, periodic newsletters, reports and other sheets that are frequently relocated or replaced in the folder. Specifically, the invention relates to improvements in the structural design disclosed in my U.S. Pat. No. 4,840,407 entitled SHEET MUSIC BINDER, issued Jun. 20, 1989.

BACKGROUND OF THE INVENTION

In the above-mentioned 4,840,407 patent, I illustrate a center post assembly or rotor which supports rubber bands on pins at the ends of the rotor. Folded sheet music is opened and one side edge is slipped under one strand of a rubber band until the fold in the center of the sheet music aligns with the band. Thereafter, that folded sheet is fully supported by the one strand. Other sheets are similarly arranged on the rotor until all sheet music for a particular program is in place and ready to be used by the individual of the choral group. In actual use, a few problems were discovered in the patented design, however, and it is primarily those problems which the present invention is designed to overcome. When sheets were slid out from beneath their particular strand during removal from the binder, friction between the sheet face and the rubber band would tend to twist and wind up the band, sometimes causing an end of the twisted band to slip off its pin or pins. In so doing, the sheet and its band would detach from the rotor and the rubber band would then have to be removed edgewise from the sheet. The band would then have to be restretched and replaced on the pins from which it was displaced. If several adjacent bands were accidentally displaced, it was not uncommon that a replaced band could be unintentionally placed on a pair of pins that were not directly opposite one another, and that rubber band and sheets later held thereby would be slightly skewed rather than aligned parallel to the rotor.

A further potential for difficulty was in the fact that the rotor of the '407 patent was journaled on mounting brackets which were held by double-sided self-adhesive sheet material to the binder. With age and sometimes due to storage of the binder in an area of increased temperature, there existed the possibility of reduction in the gripping power of the adhesive. Furthermore, if any of the rotor parts ever required replacement, for example, if damage occurred that caused some of the pins to break, one of the self-adhesive held brackets had to be removed and new self-adhesive sheet material applied. While this approach to fastening the brackets to a folder is and remains desirable for a standard binder, it would naturally be desirable if the brackets could be supported mechanically (i.e., without self-adhesive) on a specially-made binder, and be readily mechanically attached and detached as needed in the event that the rotor or other parts had to be replaced.

SUMMARY OF THE INVENTION

A media folder or book binder provided with a rotor having elastic bands stretched between pins on its opposite ends has mounting brackets which are mechanically fastened to the spine of the folder. The brackets have trunnions facing inwardly toward the opposite ends of the rotor to journal the rotor. An important aspect of the invention is that each bracket is provided with a shroud which inhibits or prevents bands from disengaging with their supporting pins as a folded sheet is removed from or installed on the rotor under a strand of the band. In effect, winding-up of the bands during relative lateral movement of a sheet still occurs, but the adverse twisting affect of enabling the bands to slip off pins is prevented. The folder has straps fixed thereto and preferably formed integrally therewith at opposite ends of the folder's spine. These straps interact with latches on the mounting brackets to firmly hold the brackets in place mechanically.

A principal object of the invention is to provide a shroud or cover on each mounting bracket, which shroud or cover extends fairly closely around and adjacent the ends of the pins on the rotor ends, thereby essentially preventing an elastic band from being displaced from its pins as a folded sheet twists during removal from or installation on a strand of a band.

Another object is to mechanically fasten the mounting brackets to the spine of a folder by providing a pair of straps that are permanently fixed to the folder.

An ancillary object is to enable installation and removal of the brackets relative to the folder by means of a simple tool such as a screwdriver.

Another object is to provide a pin-surrounding shroud on each bracket to prevent bands from slipping off their pins, and further providing an access opening in one side of each bracket to enable replacement of a broken band through the access opening.

Still another object is to simplify the alignment of parts and placement of bands on a tube forming a primary element of the rotor by extruding the tube from plastic and forming at least one aligning groove internally and one marking element externally for purposes to be described.

Other objects and advantages will become apparent from the accompanying drawings and disclosure.

BRIEF DESCRIPTION OF THE DRAWINGS

FIG. 1 is an isometric view of the cover of a folder or binder in the open condition, illustrating a pair of straps formed integrally in the folder spine.

FIG. 2 is an exploded view of the primary components of the invention which support sheet material in the folder.

FIG. 3 is a side elevational partly-fragmentary view of a bracket designed to be directly mechanically mounted on a folder while inhibiting elastic bands from being accidentally removed from their respective pins.

FIG. 4 is a view of the bracket of FIG. 3 taken looking in the direction of the arrows 4—4 of FIG. 3.

FIG. 5 is an end view of the tube of the rotor, illustrating the internal extruded grooves which align the pins at opposite ends of the rotor and the external markings used to assure parallelism of the elastic bands on the rotor when initially placing them on the unit.

DESCRIPTION OF THE PREFERRED EMBODIMENT

A media folder or binder includes a cover 10 having a front panel 12, a rear or back panel 14 and a spine panel 16 which is flexibly hinged to inner edges of the other two panels at hinge lines 18. The folder may be any of the numerous types found in the marketplace, with or without extra internal pockets, etc. A pair of straps 20 are permanently formed or mounted at opposite ends of the spine panel 16 as shown in FIG. 1. In the version of folder illustrated, the panels are formed from a single sheet of stiff plastic material with the hinge lines being created by creases in the sheet. The straps 20 are preferably integrally formed in the folder by producing slits through the spine panel, making them stand inwardly of the folder a slight amount as seen in FIG. 1. Obviously, the straps 20 may also be separate elements that are either fastened by rivets, heat welding or other means to the inner surface of the spine panel 16. The straps, as will soon become apparent, are intended to provide a means for mechanically mounting journaling brackets 22 securely to the folder so as to firmly support a center post assembly or rotor 24 of the general type disclosed and claimed in my aforementioned U.S. Pat. No. 4,840,407.

The rotor 24 may be made up of three parts, a tube 26 and a pair of end caps or tubular hubs 28 snuggly interfitting into opposite ends of the tube 26. Except for slight differences in the manner of mechanically aligning sets of pins 30 extending axially outwardly from each of the tubular hubs 28, the assembly and operation disclosed in my '407 patent is incorporated herein by reference. The tube 26 is made as a conventional plastic extrusion, thus making it simple and inexpensive to incorporate directly in the extruding dies a means for providing aligning grooves 32 and marking grooves 34 as shown best in FIG. 5. Either one of the aligning grooves 32 mate with a tang 36 in each tubular hub 28. The hubs 28 are injection molded plastic with the tang 36 and the pins 30 integral therewith. In one form of the invention, there are ten pins on each tubular hub 28, and they are arranged symmetrically and circumferentially in a predetermined angular relation to the tang 36. The tubular hubs 28 are ideally identical and interchangeable, and the tang 36 on each can enter either one of the aligning grooves 32 and the pins 30 will all align correctly. This means that no matter how the hubs 28 are inserted into the tube 26, the pins on opposite ends of the hubs will all align and all will be parallel to the axis of the tube 26. This is important for purposes of properly arranging elastic bands such as closed loop rubber bands, only one of which is partially shown, in parallel fashion relative to the rotor. Obviously, if the bands are not mounted on aligned pins, the pages of folded sheets to be mounted on the bands 38 can take on a slight and undesirable skew. To assure that the bands are placed in parallel position on the rotor, the marking grooves 34 assist in initially aligning the bands during assembly of the rotor. Preferably, two diametrically opposite marking grooves 34 are provided, so that at least one is exposed for viewing at all times when the rotor is mounted to the folder.

With cylindrical portions 29 of both tubular hubs 28 firmly seated and aligned in the ends of the tube 26, the elastic bands 38 can be strung over the pins 30, thereby holding the hubs in seated condition and readying the rotor 24 for mounting to the cover 10. Before mounting can proceed, one of the journaling brackets 22 is first slid beneath a strap 20 as seen in FIGS. 3 and 4. When so located, a tongue 40 passes fully beneath and beyond a strap 20 until its latching edge 42 is in position to capture the strap from above. Depending on the degree of stretchability of the strap 20, it may be necessary to pass a tool such as a small screwdriver through an access opening 44 to press down on the strap and anchor the latching edge 42 over the strap. After one bracket 22 is in place, a bearing sleeve 46 located radially inward of the set of pins 30 is slid axially onto a trunnion 48 molded integrally with the bracket 22. With one bracket 22 now firmly in place on the cover 10 and one end of the rotor 24 journaled on the mounted bracket, the other bracket 22 may have its trunnion 48 engaged with its hub 28 while inserting the second bracket beneath its respective strap 20 in a manner similar to the installation of the first bracket. Upon completion of securing the second bracket to the cover, the folder is ready to receive folded sheets and be used in the intended manner.

An important improvement of this invention over my earlier patented design solves the problem of bands slipping off the pins 30, particularly when removing folded sheets from the folder. Friction of the thin bands against the paper during removal would tend to twist or wind that strand of the band on which the sheet was mounted. On occasion, an end or ends of the band would slip off a pin or pins. This would require the band's removal from the sheet and remounting it on its pins. Fortunately, removal is not normally done during a music program, but only when setting up sheet music for the next program. Nevertheless, the problem created a small nuisance, and its correction went through several phases before arriving at the present solution.

The simple solution was to create a shroud 50 surrounding the pins 30, with just enough clearance of the rubber bands 38 to make it near impossible for them to slip off the pins during sheet removal. Yet, the clearance had to be sufficient to enable replacement of a broken band with a new one. High quality rubber is used for the bands, but even they break on occasion. Because of the latching of the brackets to the straps, and even though the brackets can be removed using a screwdriver through the access opening 44, I have made provision for bands 38 to be simply replaced while leaving all of the other parts in place in the folder. I achieve this by providing an access opening 52 on the end of each mounting bracket 22 remote from the spine panel 16. The opening 52 extends arcuately a little more than ninety degrees, enabling access to at least three pins in the ten pin design illustrated. When a band 38 has to be replaced, one end of a new band can be fed through the opening 52, pulled through until the opposite end of the band approaches the appropriate pin and is then hooked over the pin. The band can then be fed into the inside of the opposing bracket until it passes beyond its pin, and by manipulating the end of the band over its respective pin through the other access opening 52, the capture of the new band is complete and the folder is ready for use.

FIG. 3 illustrates a portion of the rotor 24 in dotted lines to show the relationship of the pins 30 to the shroud 50. It also shows a slight clearance but nevertheless close relationship of the pins to the internal surface of the shroud. The shroud thus inhibits or prevents bands 30 from slipping off their respective pins, but provides sufficient clearance to allow for band replacement without disassembling the brackets from the folder.

Various changes can be made in the details of construction without departing from the spirit and scope of the invention and claims.

Having described my invention, I claim:

1. For use in connection with a media folder for supporting a plurality of replaceable folded sheets, said folder comprising a front panel, a back panel and a relatively narrow spine panel having an inside surface and lateral edges to which said front and back panels are hinged, an elongated cylindrical rotor mounted to said inside surface and having a plurality of closed-loop elastic bands extending lengthwise of said rotor for supporting folded sheets, each band being stretched over a pair of axially-opposed outwardly-protruding circumferentially-arranged sets of straight pins at opposite ends of said rotor whereby said band contacts the rotor for the full length thereof, a pair of journaling brackets rotatably mounting opposed ends of said rotor on its axis, and said journaling brackets being secured to the media folder at opposite ends of said inside surface, the improvement comprising:

each journaling bracket having a shroud portion extending radially and circumferentially outward of a respective set of pins at the adjacent end of said rotor, said shroud portion closely encompassing the adjacent set of pins at least at that area remote from said spine panel to prevent accidental displacement of a given band from a supporting pin if said given band is distorted in a manner normally tending to unhook the band from such pin during installation or removal of a folded sheet; and each said journaling bracket further being provided with an access opening axially outwardly from the rotor and aligned with a portion of a set of pins for enabling replacement of a band over its related pins without disassembling the brackets and rotor from the folder.

2. The invention set forth in claim 1 wherein each said set of pins is mounted on a tubular hub having a cylindrical portion, wherein said rotor further includes an extruded tube having an inside diameter closely slidably fitting the cylindrical portion of said tubular hub, said tube being provided with a straight internal groove therein during its extrusion and extending the fill length of the tube parallel to its axis, the cylindrical portion of each said tubular hub having a radially-outward directed tang for mating with said internal groove and aligning the sets of pins at opposite ends of said rotor, and wherein the exterior of said tube includes an extruded line parallel to its axis to serve as an aligning mark for properly placing each band on directly aligned pins at opposite ends of the rotor.

3. In a media folder having front panel, a back panel and a relatively narrow spine panel hingedly adjoining one edge of each of said front and back panels, said spine panel having a relatively flat inside surface, an elongated cylindrical rotor supported on said inside surface and having a plurality of closed-loop elastic bands extending lengthwise and circumferentially of said rotor for supporting folded sheets, each band being stretched over a pair of axially-opposed outwardly-protruding and aligned circumferentially-arranged sets of pins at opposite ends of said rotor, a pair of brackets rotatably journaling opposed ends of said rotor on its axis, and means for mounting said brackets to the media folder at opposite ends of said inside surface, the improvement comprising:

said mounting means comprising a pair of permanently-positioned straps extending crosswise of the spine panel adjacent opposite ends thereof, a latching tongue extending inwardly from each bracket and interengaging with one of said straps for fastening the bracket to the spine panel and each of said brackets having an access opening for enabling insertion of a tool inwardly from the outward end of the bracket and thereby enabling the latching edge of said tongue to be disengaged from the strap and the brackets to be removed from the spine panel.

4. The invention set forth in claim 3 wherein the inward end of each tongue includes a latching edge which cooperates with the strap with which the tongue is engaged to lock the bracket firmly to said folder.

5. The invention set forth in claim 3 wherein each said bracket is provided with a shroud circumferentially closely surrounding a portion of each of its respective set of pins remote from the spine panel and wherein said bracket further includes an access opening remote from the rotor for enabling viewing of the pins from the ends of the rotor and replacement of a band through said access opening over its related pins without disassembling the brackets and rotor from the folder.

6. The invention set forth in claim 3 wherein each said set of pins is mounted on a tubular hub having a cylindrical portion, wherein said rotor further includes a tube having an inside diameter closely slidably fitting the cylindrical portion of said tubular hub, said tube having a straight internal groove extending its full length parallel to its axis, the cylindrical portion of each said tubular hub having a radially-outward directed tang for mating with said internal groove and aligning the sets of pins at opposite ends of said rotor, and said tube being produced from an extruded plastic to create said internal groove, and wherein the exterior of said tube includes an extruded line parallel to its axis to serve as an aligning mark for properly placing each band on directly aligned pins at opposite ends of the rotor.

7. The invention set forth in claim 3 wherein the front, back and spine panels are formed from relatively stiff plastic sheet material and wherein each of said straps is formed by a slit passing through the spine panel on opposed sides of each strap.

8. The invention set forth in claim 3 wherein said straps are formed integrally with an inside surface of said spine panel.

* * * * *